United States Patent [19]

Dischler

[11] Patent Number: 4,999,072

[45] Date of Patent: Mar. 12, 1991

[54] METHOD OF MAKING AN INSOLE PRODUCT

[75] Inventor: Louis Dischler, Spartanburg, S.C.

[73] Assignee: Milliken Research Corporation, Spartanburg, S.C.

[21] Appl. No.: 168,596

[22] Filed: Mar. 4, 1988

Related U.S. Application Data

[60] Continuation-in-part of Ser. No. 110,233, Oct. 19, 1987 abandoned, which is a division of Ser. No. 920,590, Oct. 20, 1986, abandoned.

[51] Int. Cl.[5] ..... A43B 13/20; B32B 31/06

[52] U.S. Cl. ..... 156/145; 156/219; 156/251; 156/256; 156/263; 36/29

[58] Field of Search ..... 156/145–147, 156/251, 515, 273.5, 219, 220, 250, 263, 256; 36/43, 44, 29, 28; 12/142 N, 146 M; 128/594

[56] References Cited

U.S. PATENT DOCUMENTS

| | | | |
|---|---|---|---|
| 2,407,495 | 10/1946 | High et al. | 156/538 X |
| 2,481,602 | 9/1949 | Lindh | 156/290 |
| 2,671,277 | 3/1954 | Montgomery | 36/44 X |
| 2,677,906 | 11/1954 | Reed | 36/44 X |
| 3,004,877 | 10/1961 | Simms et al. | 156/145 X |
| 3,170,178 | 2/1965 | Scholl | 36/44 X |
| 3,170,250 | 2/1965 | Scholl | 156/251 X |
| 3,914,881 | 10/1975 | Striegel | 36/44 |
| 4,670,995 | 6/1987 | Huang | 36/29 |
| 4,693,940 | 9/1987 | Vodges | 156/273.5 X |

*Primary Examiner*—Michael W. Ball
*Assistant Examiner*—Jeff H. Aftergut
*Attorney, Agent, or Firm*—Earle R. Marden; H. William Petry

[57] ABSTRACT

A film encapsulated, gas cushion insole product which maintains its shape by means of a core fabric therein to which a desiccant may be added, if desired. To contain the gas for long periods of time, the film contains a layer of polyvinylalcohol.

6 Claims, 4 Drawing Sheets

*FIG. —4—*

METHOD OF MAKING AN INSOLE PRODUCT

This application is a continuation-in-part of U.S. patent application Ser. No. 110,233, filed Oct. 19,1987 now abandoned, which in turn is a division of U.S. patent application Ser. No. 920,590, filed Oct. 20, 1986, now abandoned.

This invention relates generally to a method to provide a new and novel shoe insole product which is capable of absorbing the stress of walking and running for long periods of time without having to be replaced.

An object of the invention is to provide an inflated, substantially flat shoe insole product that provides cushioning for the wearer with minimal energy loss and which has a long service life before replacement is necessary.

Other objects and advantages of the invention will become readily apparent as the specification proceeds to describe the invention with reference to the accompanying drawings, in which.

Figure 1:
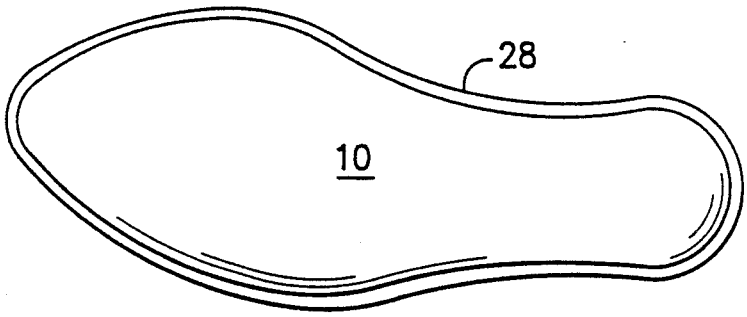
FIG. 1 is a top view of the new and improved shoe insole product.

Looking now to the drawings, the reference numeral 10 represents the new and novel insole product which either can be employed as an insert for a shoe or can be an integral part of the shoe. The insole product 10 basically consists of a core fabric 12, such as a double plush warp knit fabric which has the fibers oriented perpendicularly, an encapsulating plastic film 14 and a cover fabric 16, if desired, preferably a stretch woven or knit fabric to provide abrasion and puncture resistance, ventilation, esthetics and a medium friction surface. If desired, a liquid desiccant or drying agent 18 such as lithium chloride brine can be sprayed or coated on the core fabric 12.

Figure 3:
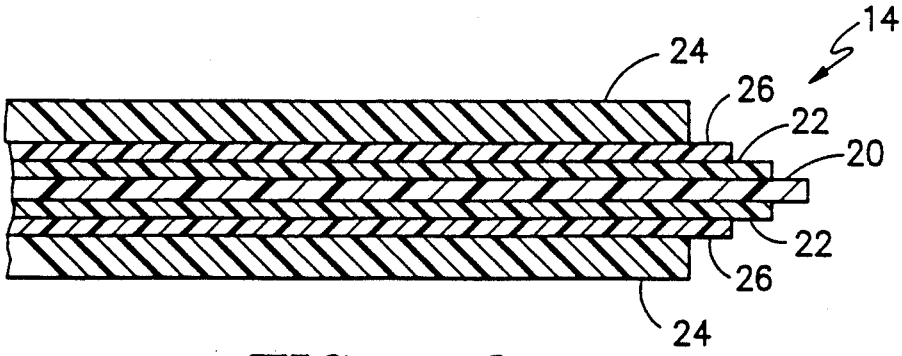
FIG. 3 is a cross-sectional view of the barrier film shown schematically in FIG. 2.

The barrier film 14, shown in detail in FIG. 3, has a composition such that low molecular weight gases, as well as so-called super-gases, can be used as the inflation medium of the insole 10. The co-extruded barrier film 14 basically consists of a layer 20, such as polyvinyl alcohol having high gas barrier properties, a layer 22 of nylon 6 on both sides of the film 20 and a layer 24 of very low density polyethylene on the outer side of each of the film layers 22 and adhered thereto by a tie-layer of adhesive 26 which is preferably a high temperature polyethylene-vinyl acetate copolymer.

Figure 4:
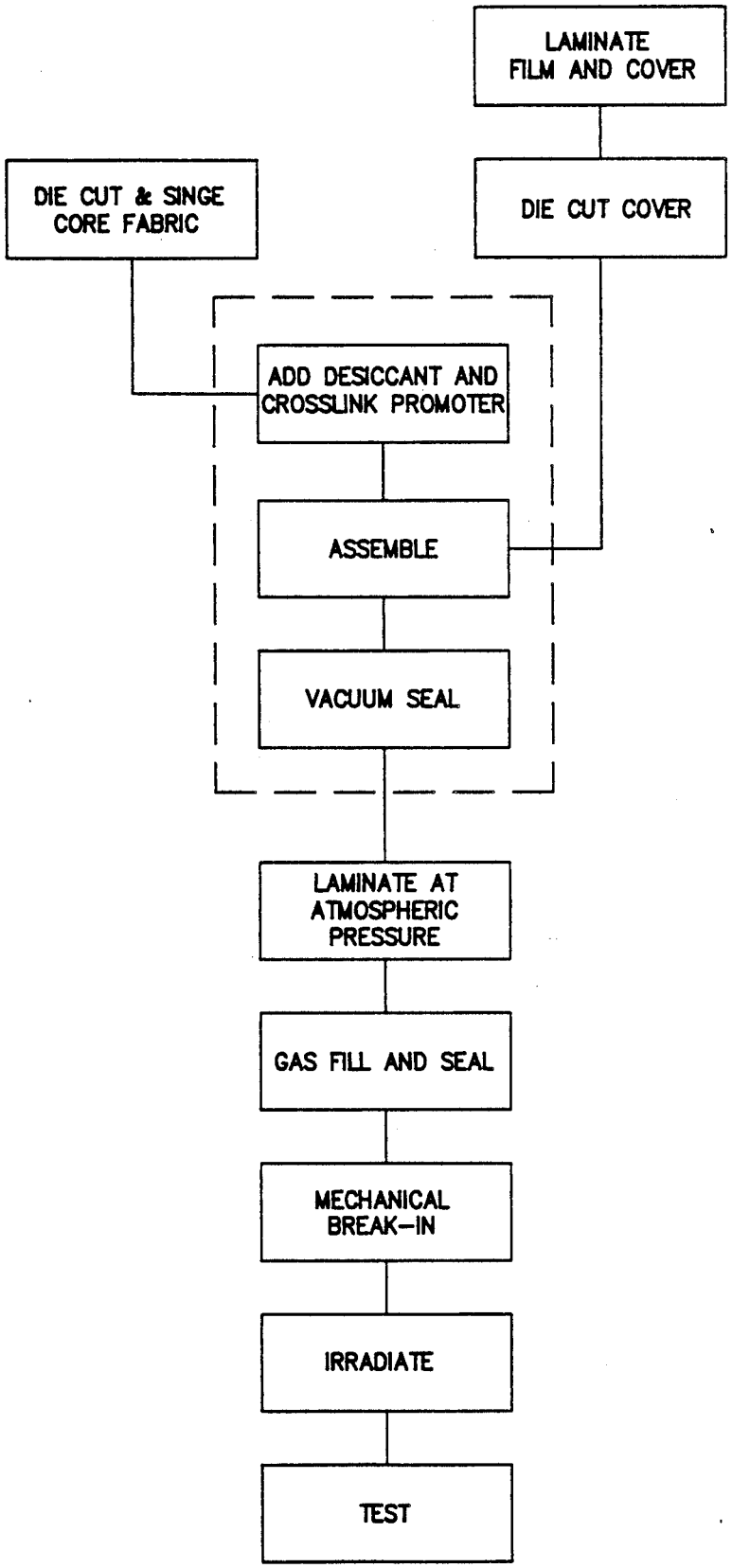
FIG. 4 is a schematic block representation of the steps employed in the production of the product shown in FIG. 1.

Looking now to FIG. 4, the production of the insole product 10 is shown in block form. Initially, the core fabric is die cut to the desired size and the edges thereof singed to remove protruding fibers. In a separate operation, the barrier film 14 is laminated to the cover fabric 16. Then the laminated film and fabric is die cut to a size slightly larger than the die cut core fabric to allow for the flange seal 28 around the insole product 10. The die cut core fabric has the desiccant 18 dropped or sprayed thereon and then is assembled with the die cut film and cover fabric in a vacuum chamber. The desiccant serves to keep the humidity sensitive barrier film dry.

Figure 2:
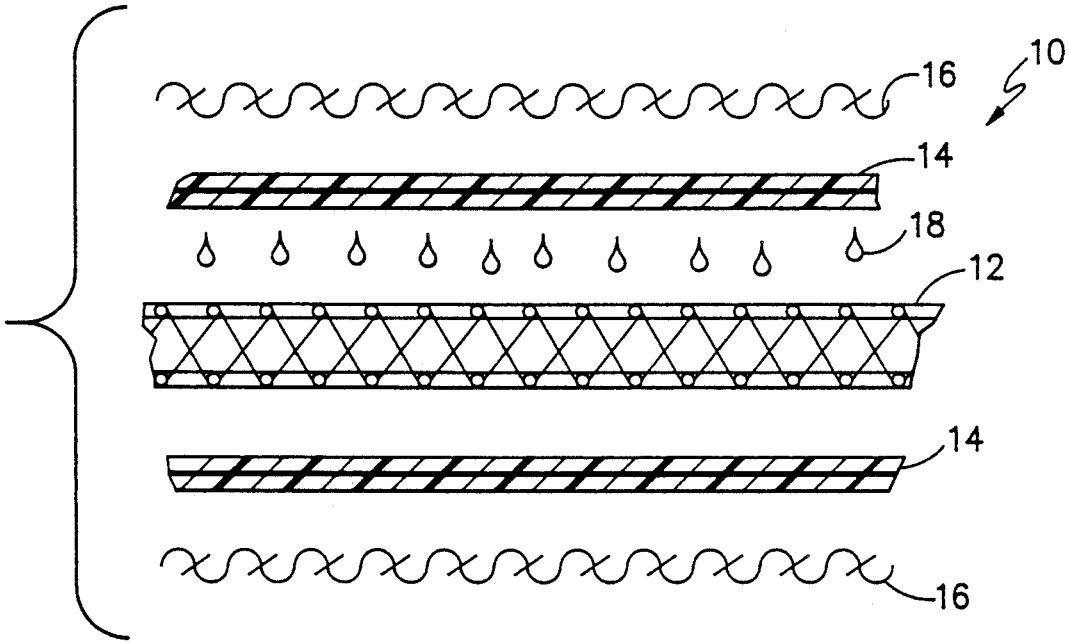
FIG. 2 is an exploded, partially schematic cross-sectional view of the product shown in FIG. 1.

Looking at FIG. 2, the assembly is shown with the die cut core fabric 12 located between two substantially identical die cut film and cover fabric members 14, 16. As indicated, this assembly is placed in a vacuum chamber. As hereinafter explained, the film layers are bonded together to form the basic edge sealed, flat insole structure with the core fabric under vacuum. The films are then bonded to the core fabric.

The insole product is then inflated with a gas, preferably a low molecular weight gas to a pressure of about 27 p.s.i.g., and re-sealed. The inflated pressure, preferably, is in the range of 20–30 p.s.i.g. but, if desired, can be within the range of 10–50 p.s.i.g. The inflated insole product is then broken in by stretching the plastic film with respect to the core fabric and subsequently tested to detect leaking insole products. The bonded and gas filled insole structure is then irradiated with gamma rays from a cobalt source to cross-link the layers to impart greater resistance to flex-cracking to the insole product.

Figure 5:
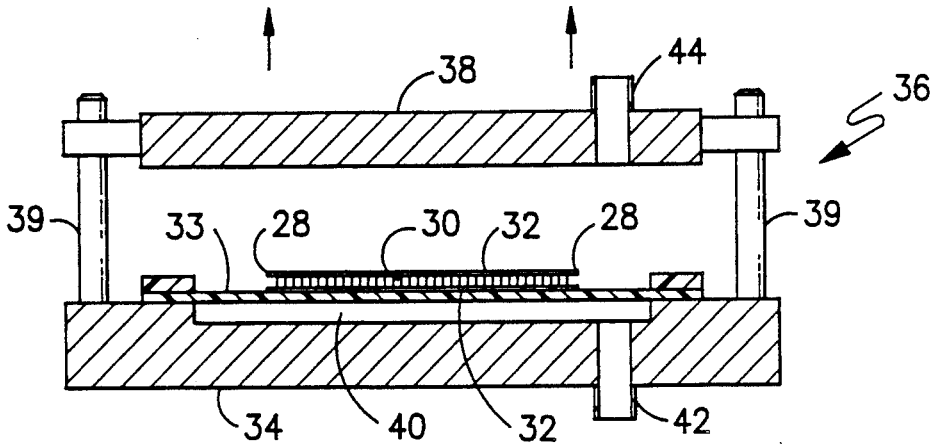
FIGS. 5–7 show the steps in the production of the basic encapsulated product.
Figure 6:
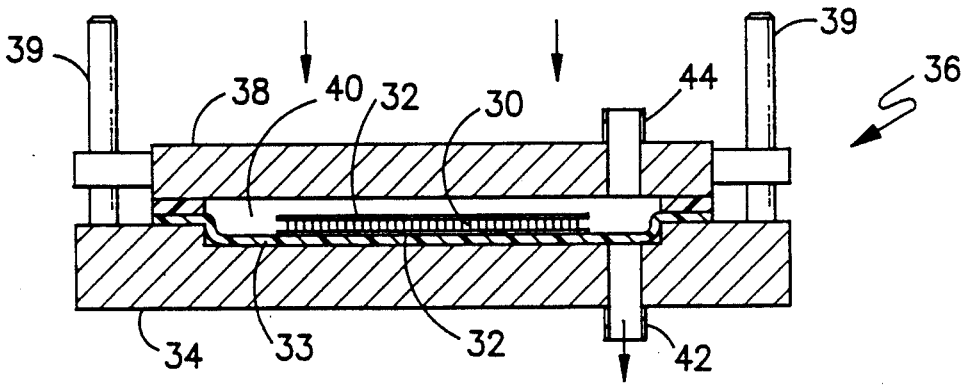
Figure 7:
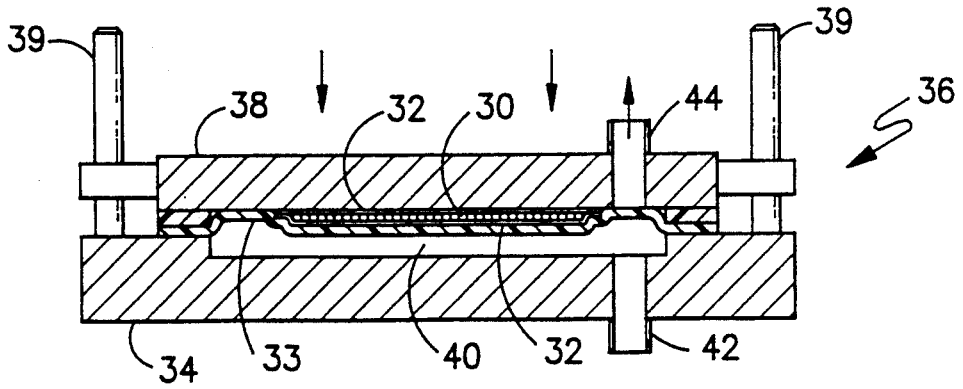

Looking now to FIGS. 5–7 show the vacuum sealing of the edge seals 28 of the insole product. As mentioned, the various die cut members are assembled into a stack 30 with edges of the fabric covered barrier film 32 extending beyond the singed edges of the core fabric 12. The stack 30 is placed on the rubber-like diaphragm 33 mounted on the lower platen 34 of the vacuum device 36. Then the heated upper platen 38 is slid down on the guide posts 39 to seal off the vacuum chamber 40. A vacuum is then pulled through the conduit to pull the diaphragm 33 and the stack 30 in the position shown in FIG. 6. Then vacuum is applied to conduit 44 and subsequently the vacuum is released at conduit 42 to allow the diaphragm 33 and the stack 30 to move upward to the position shown in FIG. 7 so that the heat of the upper platen 38 and pressure of the diaphragm 33 will seal the edges 28 to encapsulate the core fabric 12 in the absence of air. The vacuum pressure is then released and the insole product removed and placed in an atmospheric oven where the stack 30 is heated to a temperature of about 350° C. for 15 minutes to bond the barrier film 14 to the core fabric 12. The time and temperature can be varied depending on the desiccant on the core fabric and the adhesive film used. A pressurized oven may be used to achieve a faster cycle time, if desired.

Figure 8:
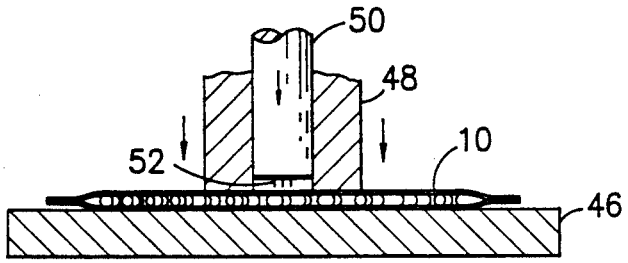
FIGS. 8–10 show the steps in the inflation of the product produced by the steps of FIGS. 5–7.
Figure 9:
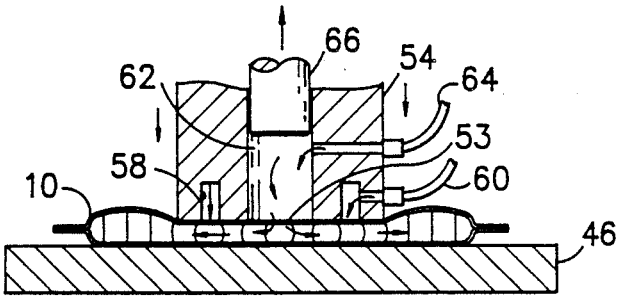
Figure 10:
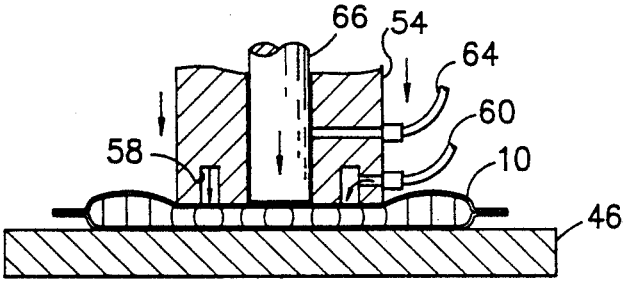
Figure 11:
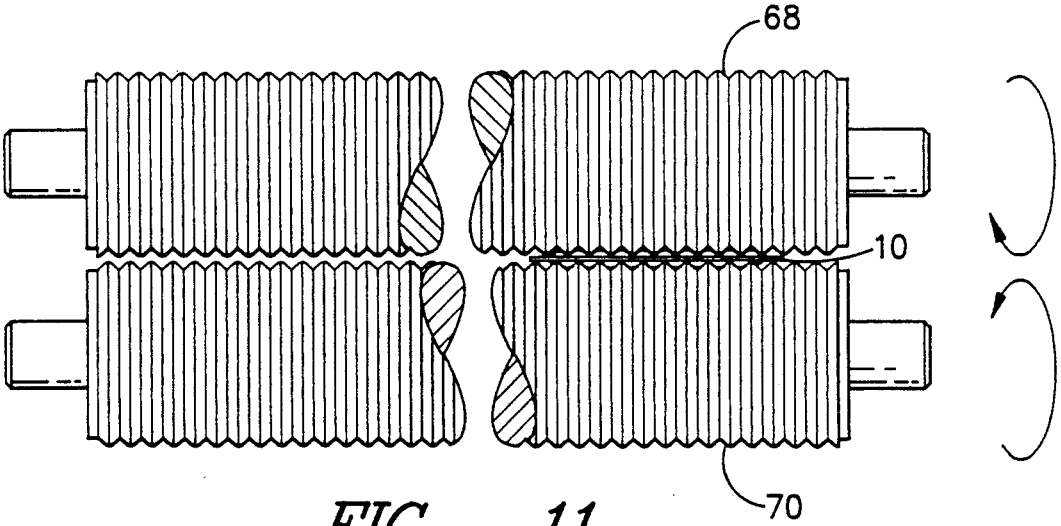
FIG. 11 represents the method of breaking in the insole product by stretching the encapsulating film.

After the insole product has been laminated, it is moved to the inflation apparatus schematically represented in FIGS. 8–10. The insole product 10 is placed on the platen 46 under the cylinder 48 which is moved downwardly thereagainst while the rod 50, slidably mounted therein, also moves downwardly to cause the pins 52 to penetrate the cover barrier film to provide holes 53 therein to expose the interior of the insole product. Then the platen 46 is indexed to another station under a second cylinder 54 which is moved downwardly against the insole product with a force which, along with the pressurized gas supplied into cavity 58 via conduit 60, provides a seal sufficient to eliminate loss to the atmosphere of the gas being supplied into the cavity 62 via conduit 64. As mentioned before, the gas supplied into cavity 62 is, preferably, a low molecular weight gas which passes through the holes 53 into the interior of the insole product to inflate same. The heated rod 66 is moved downwardly against the insole product 10 with sufficient pressure and time to seal the holes 53 to prevent the escape of gas from the inflated insole product 10. The heated rod 66 is then retracted and the film is allowed to cool for several seconds before the gas pressure in cavity 62 is released in order to avoid delamination of the hot adhesive from the now pressurized core.

The insole product 10 is then removed from the platen 46 and delivered between the rotating grooved rolls 68 and 70 to stretch the barrier film in order to soften and break-in the insole product. If desired, after a predetermined amount of time, the pressure on the insole product can be checked to see if any gas has leaked therefrom.

Finally, the product is irradiated to a level of 6MR or more to crosslink the adhesive and the layers to achieve much greater flex life.

As discussed previously, the particular barrier film construction is employed in order to use and contain low molecular weight gas to provide good thermal conductivity. This -does not preclude the use of the so called super-gases but it is desired to have a construction that will retain the low molecular weight gases in order to obtain the use of the inherent characteristics thereof. Examples of low molecular gases that can be used in the insole product could include hydrogen, deuterium, helium, methane, nitrogen, ethane, argon, fluoroform, neo-pentane, and tetrafluoromethane. Where low thermal conductivity is not required, higher molecular weight gases may be used.

The herein disclosed method provides an insole product which has a long service life so that the user is not constantly having to replace same to obtain the comfort and shock absorbing qualities of the product. The polyvinylalcohol film and, especially, in combination with the desiccant provides a long life insole product which obtains the thermal conductivity advantages of a low molecular weight gas resulting in the reduction or elimination of hot spots. Furthermore, the barrier film construction prevents the ingress of atmospheric gases thereby reducing the oxidative degradation of the adhesive film and the core fabric.

Although the preferred embodiment of the invention has been described, it is contemplated that many changes may be made without departing from the scope or spirit of the invention, and it is desired that the invention only be limited by the claims.

I claim:

1. The method of manufacturing an insole product comprising the steps of: die-cutting a core fabric, die-cutting at least two barrier films to a size slightly larger than the core fabric, treating the core fabric with a desiccant prior to encapsulation between the barrier films, placing the core fabric between at least two of the die cut barrier films, sealing the edges of the barrier films around the core fabric to encapsulate the same, punching a hole in one of the barrier films, delivering a low molecular weight gas at a pressure in the range of 10–50 p.s.i.g. into the insole product through the hole and sealing the hole previously punched in the barrier film.

2. The method of claim 1 wherein the desiccant is applied after the core fabric is die-cut.

3. The method of claim 2 wherein the edges of the die-cut core fabric are singed prior to encapsulation.

4. The method of claim 2 wherein a cover fabric is laminated to the barrier film prior to die-cutting thereof.

5. The method of claim 1 wherein said pressure is in the range of 20–30 p.s.i.g.

6. The method of claim 5 wherein said pressure is about 27 p.s.i.g.

* * * * *